US005330162A

United States Patent [19]

Nakashima et al.

[11] Patent Number: 5,330,162

[45] Date of Patent: Jul. 19, 1994

[54] DIPPING AND POURING APPARATUS FOR MOLTEN METAL

[75] Inventors: Mitsukane Nakashima; Yasunori Nakatsuka, both of Nagoya; Toei Sano, Kasugai, all of Japan

[73] Assignee: Meichuseiki Kabushiki Kaisha, Aichi, Japan

[21] Appl. No.: 66,227

[22] Filed: May 25, 1993

[30] Foreign Application Priority Data

Jul. 29, 1992 [JP] Japan ..... 4-058974[U]

[51] Int. Cl.[5] ..... B22D 41/16

[52] U.S. Cl. ..... 266/236; 222/598; 222/602

[58] Field of Search ..... 266/236; 222/597, 598, 222/602

[56] References Cited

U.S. PATENT DOCUMENTS

| | | | |
|---|---|---|---|
| 3,651,998 | 3/1972 | Rocher | 222/598 |
| 5,037,017 | 8/1991 | Luhrsen et al. | 222/598 |
| 5,078,306 | 1/1992 | Keller et al. | 222/598 |
| 5,145,634 | 9/1992 | Hintzen | 222/598 |
| 5,154,875 | 10/1992 | Luchs | 222/598 |

*Primary Examiner*—Scott Kastler

*Attorney, Agent, or Firm*—Armstrong, Westerman, Hattori, McLeland & Naughton

[57] ABSTRACT

A dipping and pouring apparatus includes a molten metal holder which received a molten metal, a duct which is provided at the bottom of the molten metal holder and which opens into the air, and a valve member provided in the duct. The valve member is provided with a main axial passage opening into the air and at least one branch passage connected to the main passage. The valve member selectively connects the interior of the molten metal holder to the axial main passage.

8 Claims, 9 Drawing Sheets

DIPPING AND POURING APPARATUS FOR MOLTEN METAL

BACKGROUND OF THE INVENTION

1. Field of the Invention

The present invention relates to a dipping and pouring apparatus of molten metal, such as molten aluminium.

2. Description of Related Art

A ladle 50 as shown in FIG. 13 has been used to dip and transfer molten metal into a mold.

When the ladle 50 is directly plunged into, for example, molten aluminium contained in a furnace to scoop the molten metal, oxide produced in an upper surface portion of the molten metal in the furnace can be contained in the molten aluminium ladled in and by the ladle 50.

Furthermore, when the ladle 50 is inclined to transfer the ladled molten metal therefrom into a molding cavity through an outlet port 51 of the ladle 50, as shown in FIG. 13, the pour (quantity) and direction of a flow of the molten metal depend on the inclination angle of the ladle 50. Namely, as can be seen in FIG. 13, the flows "a" and "c" are farthest from and closest to the outlet port 51, respectively, and the flow "b" is intermediate therebetween. The quantity of molten metal decreases from the flow "a" towards the flow "c", and the pouring points of the flows "a", "b" and "c" are different from each other.

To eliminate the drawbacks mentioned above, the applicant of the present application has proposed an improved container for molten metal, including a movable refractory container body which is provided on the bottom thereof with a connecting passage opening into the air, and a valve stem which is reciprocally moved in the connecting passage to selectively establish the fluid connection of the connecting passage to the air (e.g., Japanese Unexamined Patent Publication No. 3-258455).

In the improved container, as disclosed in JPP '455, a constant quantity of molten metal can be poured from the container at the same pouring point thereof in the same direction. Furthermore, the molten metal is discharged from the bottom of the container, and accordingly, no oxide produced in the upper surface portion of the molten metal is poured in the molding cavity together with the molten metal.

Nevertheless, in the container disclosed in JPP '455, there are plurality of flows of molten metal produced when the molten metal flows through a plurality of connecting grooves formed in the valve stem, thus resulting in an occurrence of turbulence.

Upon pouring, the molten metal may be scattered due to the turbulent flows, so that the molding dies or surroundings thereof can be soiled with the scattered molten metal, or air bubbles can be contained in the molten metal.

The primary object of the present invention is to eliminate the drawbacks mentioned above by providing a dipping and pouring apparatus in which a constant quantity of molten metal can be poured in the same direction at a constant pouring point, without occurring a turbulence flow.

SUMMARY OF THE INVENTION

To achieve the object mentioned above, according to an aspect of the present invention, there is provided a dipping and pouring apparatus of molten metal comprising a molten metal holder which receives a molten metal, a duct which is provided at the bottom of the molten metal holder and which opens into the air, and a valve member provided in the duct, said valve member being provided with a main axial passage opening into the air and at least one branch passage connected to the main passage, said valve member selectively connecting the interior of the molten metal holder to the axial main passage.

According to another aspect of the present invention, there is provided a dipping and pouring apparatus comprising a container for receiving a molten metal, an outlet means for connecting the interior of the container to the exterior of the container, and a valve means for selectively connecting the interior and exterior of the container through the outlet means, said valve means being provided with a main passage connected to the outlet means and at least one branch passage which is connected to the main passage to connect the main passage to the interior of the container.

Preferably, the valve means comprises a valve body which is movable between an open position in which the interior of the container is connected to the main passage through the branch passage and a closed position in which the connection of the interior of the container to the main passage is broken.

Preferably, provision is made of a protecting means for preventing the valve member from being directly brought into contact with the molten metal contained in the container.

Provision is also made to a seal means for preventing the molten metal contained in the container from leaking therefrom.

BRIEF DESCRIPTION OF THE DRAWINGS

The invention will be described below in detail with reference to the accompanying drawings, in which.

DESCRIPTION OF THE PREFERRED EMBODIMENT

FIGS. 1 through 6 show a first embodiment of a dipping and pouring apparatus of the present invention, and FIGS. 7 through 12 show a second embodiment of a dipping and pouring apparatus of the present invention, respectively.

Figure 1:
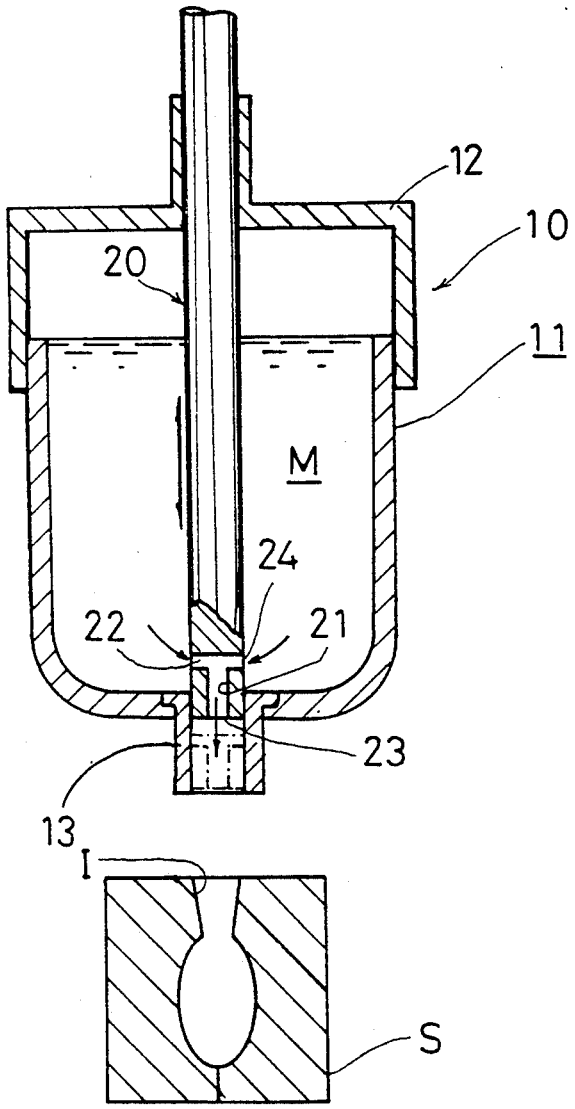
FIG. 1 is a sectional view of a dipping and pouring apparatus according to a first embodiment of the present invention.

In FIG. 1, a molten metal holder 10 includes a container 11 which is suspended from a movable conveyer (not shown) to move the container 11, so that the molten metal M dipped from a smelting furnace is transferred to a molding die S. The molten metal M is poured into the molding die, i.e., the molding cavity defined by the molding die S through an inlet I of the molding cavity. Numeral 12 designates an upper cover of the container 11.

The container 11 is made of refractory material, such as ceramic and is provided on the bottom thereof with a cylindrical duct 13 opening into the air. The cylindrical duct 13 is preferably made of ceramic piece separate from the container 11 and is exchangeably connected to the container 11.

A valve member 20 is slidably fitted in the cylindrical duct 13 to selectively establish the fluid connection between the inside and outside of the container 11. The valve member 20 extends through the container 11 and is connected to an external hydraulic actuator (not shown), so that the valve member 20 is reciprocally moved in the axial direction thereof.

Figure 2:
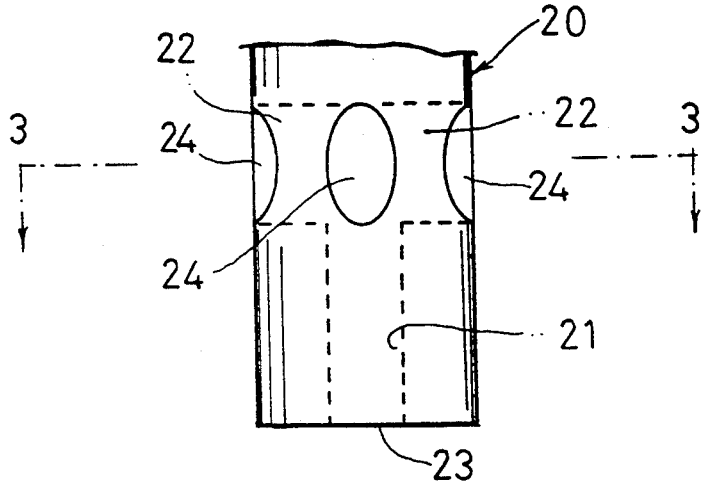
FIG. 2 is an enlarged view of a valve member of a dipping and pouring apparatus shown in FIG. 1.
Figure 3:
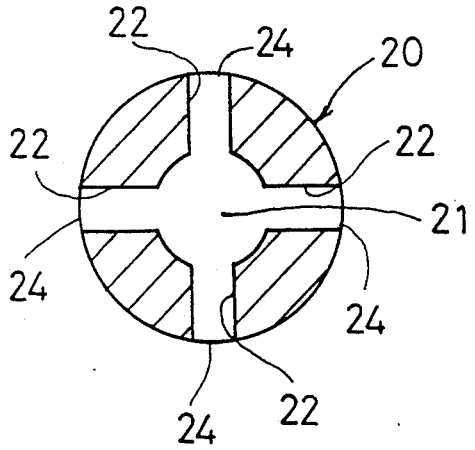
FIG. 3 is a sectional view taken along the line III—III in FIG. 2.

The valve member 20 is provided with one axial main passage 21 which opens at the front end 23 thereof into the air and one or a plurality of branch passages 22 which are connected to the main passage 21 and open at the outer ends 24 thereof into the peripheral surface of the valve member 20, as can be seen in FIGS. 2 and 3.

Although there are four branch passages 22 which radially extend from the axial passage 21 in the illustrated embodiment, the number of the branch passages is not limited to four, and can be smaller or larger than four. It is possible to provide a single branch passage 22. The number of the branch passages depends on the dipping efficiency or the viscosity of the molten metal to be poured.

The rearward movement (i.e., the upward movement in FIG. 1) of the valve member 20 causes the branch passages 22 to be connected to the interior of the container 11 through the open ends 24 thereof, so that the molten metal M can be dipped up into the container 11 through the single axial passage 21 or poured from the container 11 into the molding die S. When the molten metal M is dipped up into the container 11 or discharged from the container 11 into the molding die S, there is a single flow of the molten metal defined by the single axial passage 21.

When the valve member 20 is moved forward (downward in FIG. 1), as shown in an imaginary line in FIG. 1, the open ends 24 of the branch passages 22 are closed by the inner wall of the duct 13, so that the fluid connection between the axial passage 21 and the interior of the container 11 is broken. Consequently, no flow of the molten metal M takes place.

Figure 4:
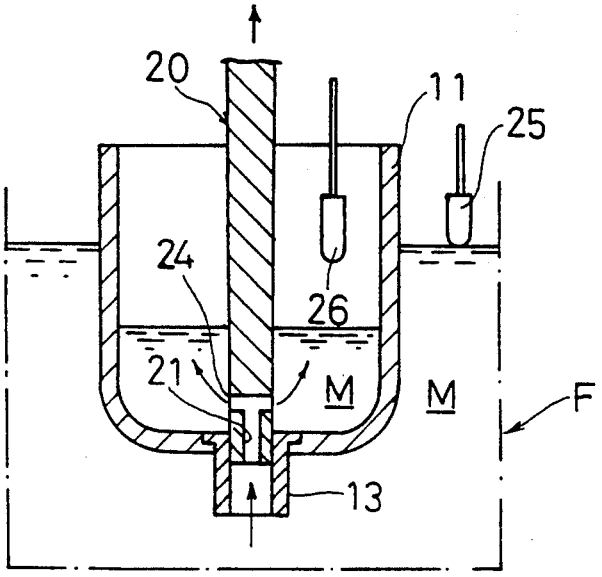
FIG. 4 is a sectional view of a molten metal holder shown in a dipping position in which molten metal is dipped up into the molten metal holder.
Figure 5:
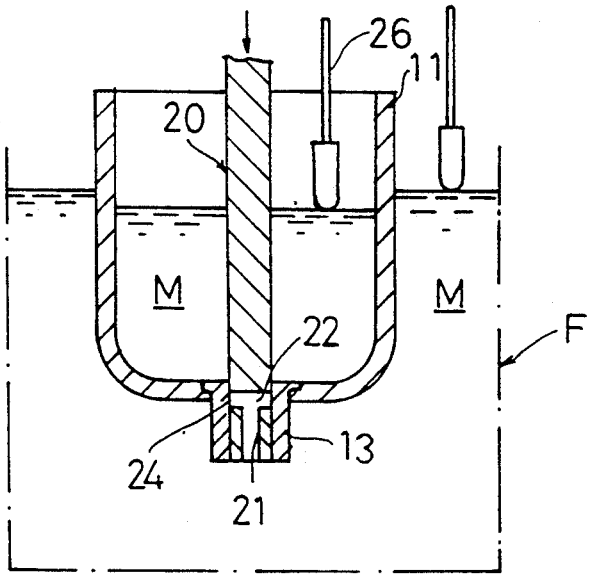
FIG. 5 is a sectional view of a molten metal holder shown in a completion position in which the dipping operation is completed.

The dipping and pouring apparatus as constructed above operates as follows (FIGS. 4 and 5).

The container 11 is lowered and dipped into the molten metal M contained in the smelting furnace F by a conveyer (not shown). Thereafter, the valve member 20 is moved upward, so that the open ends 24 of the branch passages 22 are connected to the interior of the container 11. Consequently, the molten metal M flows into the container 11 through the duct 13 and the valve member 20 (axial passage 21 and the branch passages 22), as shown by arrow in FIG. 4. The upper surface level of the molten metal M in the smelting furnace F is detected by a detector 25 and the upper surface level of the molten metal M in the container 11 is detected by a detector 26, respectively.

When the dosing detector 26 detects that the upper surface of the molten metal M in the container 11 reaches a predetermined level, that is, when a predetermined quantity of molten metal is received in the container 11, the valve member 20 is moved downward, so that the open ends 24 of the branch passages 22 are closed by the inner wall surface of the duct 13, as shown in FIG. 5.

The molten metal M dipped up into the container 11 is conveyed together with the container 11 by the conveyer (not shown). When the container 11 comes to the molding die S, the molten metal M is poured into the molding die S, as shown in FIG. 1. Upon pouring the molten metal, the valve member 20 is moved up again to open the open ends 24 of the branch passages 22, so that the molten metal M in the container 11 can be discharged into the molding die S through the axial passage 21 and the duct 13. It should be appreciated that a single flow of the molten metal M is produced in the duct 13, and accordingly, no turbulence flow takes place when the molten metal M is poured in the molding die S.

Figure 6:
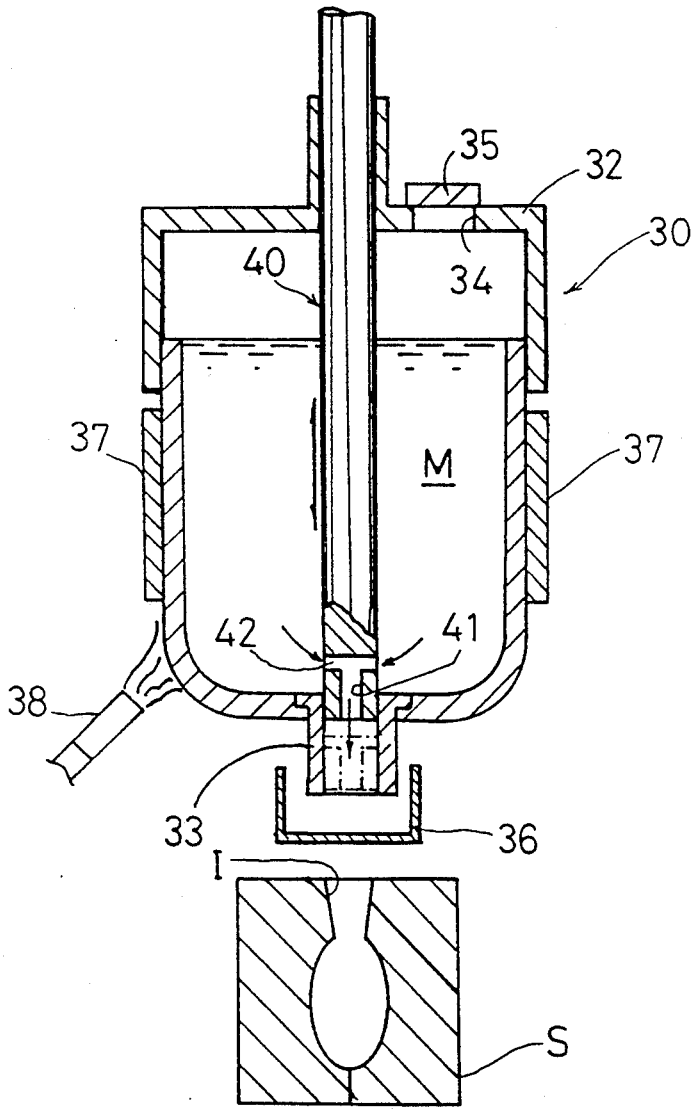
FIG. 6 is a sectional view of a modified arrangement of FIG. 1, in which the molten metal holder is constituted by a molten metal holding furnace.
Figure 7:
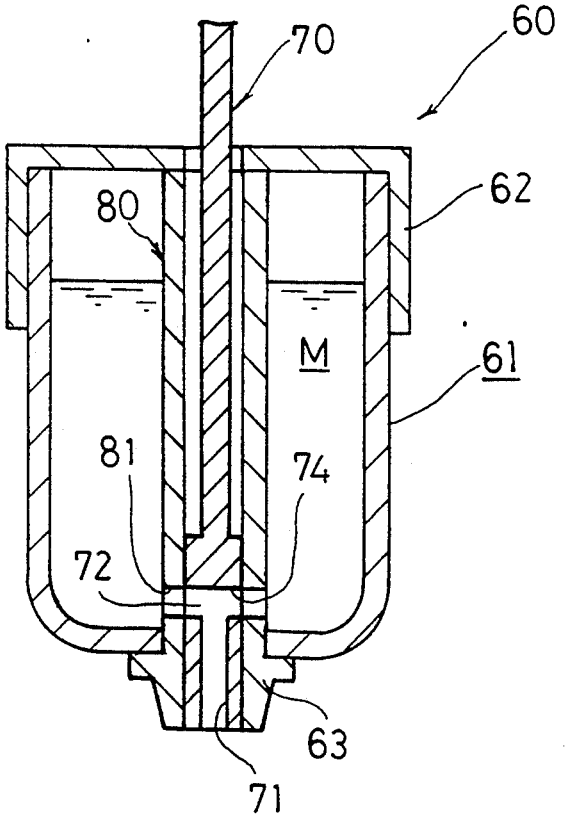
FIG. 7 is a sectional view of a molten metal holder according to a second embodiment of the present invention.

FIG. 6 shows a modified arrangement of a molten metal holder which is constituted by a molten metal holding furnace 30. The molten metal holding furnace 30 is provided on the bottom thereof with the duct 33 secured thereto. The valve member 40 is slidably fitted in the duct 33, as shown at a phantom line in FIG. 6. Numerals 32, 34, 35, 36, 41 and 42 respectively designate the upper cover of the container, the inlet opening of a raw material formed in the upper cover 32, the lid of the inlet opening 34, the movable receptacle 36 which receives the molten metal leaking from the duct 33, the main axial passage formed in the valve member 40, and the branch passages connected to and extending from the axial passage 41.

The holding furnace 30 is immovably held at a predetermined position above the molding die S, and is heated by a heater 37 or a burner 38 to maintain the temperature of the molten metal M in the holding furnace 30 at a predetermined value. The molding dies S are successively conveyed to a pouring position located directly below the holding furnace 30, so that the molten metal M contained in the holding furnace 30 can be successively poured in the molding dies S through the inlet openings I thereof.

FIGS. 7 through 12 show a second embodiment of the present invention.

The molten metal holder 60 includes a container 61 which is provided therein with a central protecting cylinder 80 in which the valve member 70 is slidably inserted. The container 61 is closed by an upper cover 62.

The protecting cylinder 80 is provided on the lower portion thereof with inlet ports 81. The duct 63 is integrally formed with the lower end of the protecting cylinder 80 and externally extends through the bottom of the container 61 of the molten metal holder 60.

Figure 10:
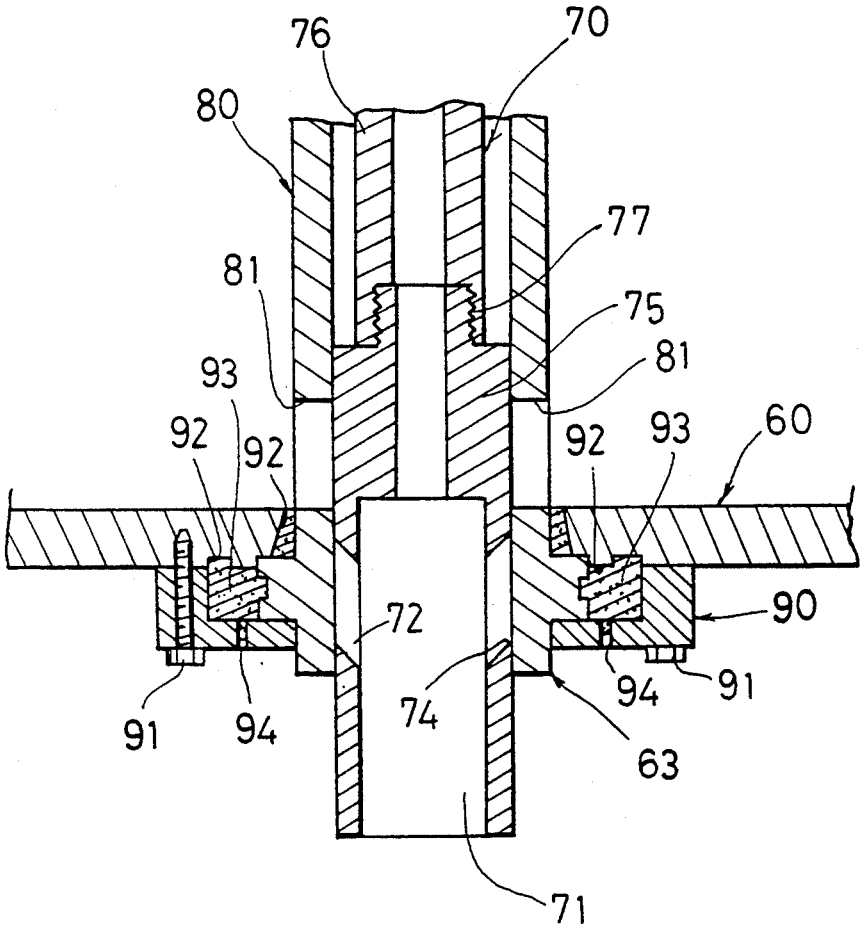
FIG. 10 is an enlarged view of a valve member of a dipping and pouring apparatus shown in FIG. 7.

The duct 63 is attached to the bottom of the container 61 preferably by an annular mounting member 90 having a generally U-shape in axial section, as shown in FIG. 10. The mounting member 90 is secured to the bottom of the container 61 by set screws 91.

Preferably, there is a space 92 between the duct 63 and the mounting member 90 when the latter is secured to the bottom of the container 61. The space 92 is filled with a seal member 93, for example, made of mortar. Any excess filler (seal member) 93 can be discharged through discharge holes 94 formed in the mounting member 90. The seal member 93 prevents a leakage of the molten metal from the bottom of the holder 60.

The valve member 70 includes a valve body 75 and a valve stem 76 which is detachably screwed into the valve body 75 through a threaded portion 77. The valve body 75 is detached from the valve stem 76 for example when the valve body is cleaned or exchanged. The valve body 75 is provided with an axial main passage 71 which opens into the air at the lower end thereof and branch passages 72 which radially extend from the axial passage 71 to open into the peripheral surface of the valve body 70.

Figure 8:
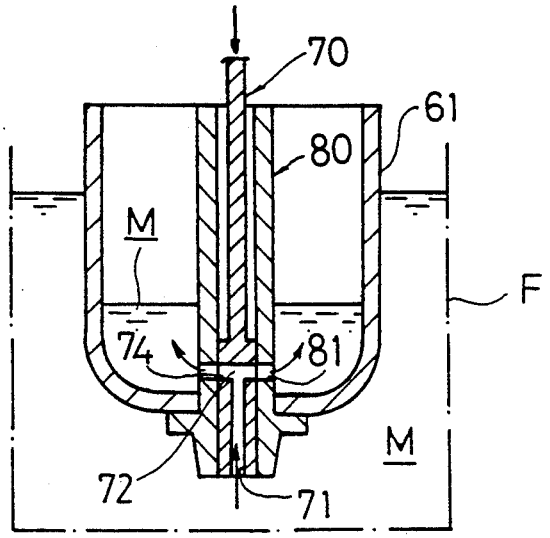
FIG. 8 is a sectional view of a molten metal holder shown in FIG. 7, shown in a dipping position in which molten metal is dipped up into the molten metal holder.

The valve member 70 is movable up and down in the axial direction thereof to selectively establish the fluid connection between the interior and exterior of the container 61 through the valve member 70. Namely, as can be seen in FIG. 8, when the valve member 70 is moved down, the open ends 74 of the branch passages 72 are registered with the inlet ports 81 of the protecting cylinder 80, so that the molten metal M contained in the smelting furnace F can be dipped up therefrom into the container 61 through the main passage 71 and the branch passages 72 of the valve member 70.

Figure 9:
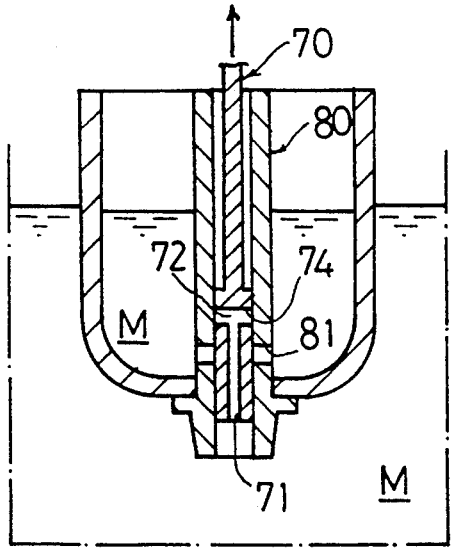
FIG. 9 is a sectional view of a molten metal holder shown in FIG. 7, shown in a completion position in which the dipping operation is completed.

Upon completion of the dipping of the molten metal, the valve member 70 is moved up as shown in FIG. 9. Consequently, the open ends 74 of the branch passages 72 are closed by the inner wall surface of the protecting cylinder 80, so that the molten metal M contained in the container 61 is retained therein.

Figure 11:
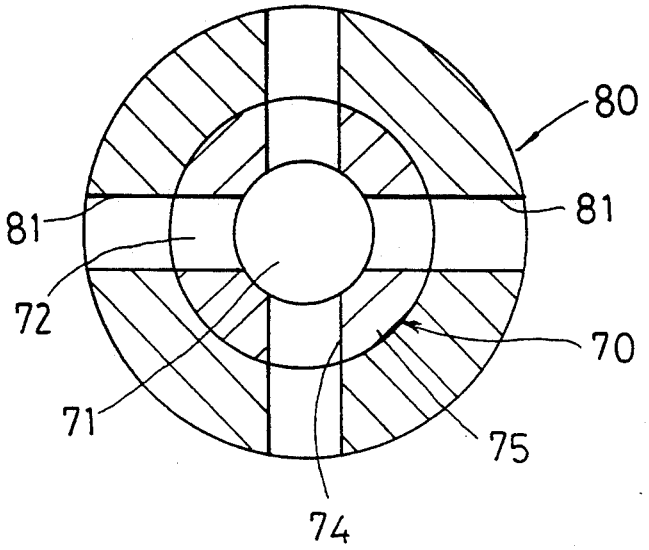
FIG. 11 is a cross sectional view of a rotatable valve member shown in an open position.

It is also possible to switch the valve member 70 between the open position (FIG. 8) and the closed position (FIG. 9) by rotating the same, instead of the axial movement thereof. Namely, as can be seen in FIG. 11, the open ends 74 of the branch passages 72 are registered with the inlet ports 81 of the protecting cylinder 80 only when the valve member 70 is rotated by a predetermined angular displacement. In the open position shown in FIG. 11, the molten metal M can be dipped in the container 61 or poured from the container 61 into the molding die S.

Figure 12:
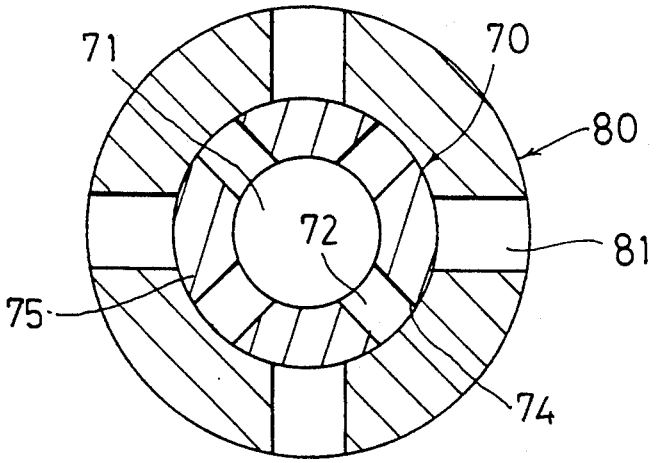
FIG. 12 is a cross sectional view of a rotatable valve member shown in a closed position; and, FIG. 13 is a sectional view of a conventional ladle for molten metal.
Figure 13:
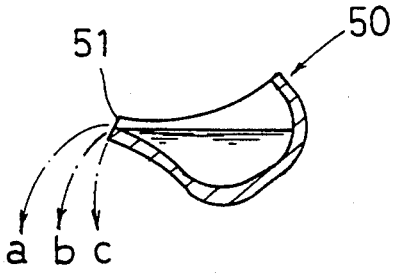

Conversely, when the open ends 74 of the branch passages 72 are closed by the inner wall surface of the protecting cylinder 80 by the rotation of the valve member 70, as shown in FIG. 12, no flow of the molten metal M into or from the container 61 occurs.

In the second embodiment in which the valve member 70 is inserted in the protecting cylinder 80, there is little direct contact of the valve member 70 with the molten metal M, and accordingly, no molten metal is stirred or disturbed, thus resulting in no production of air bubbles in the molten metal M. Consequently, the molten metal M of high quality can be obtained. Furthermore, the valve member can be easily and certainly actuated to switch the fluid connection.

In addition to the foregoing, since the valve member 70 comes into contact with the molten metal M only at an extremely small surface area thereof, no or few oxide is stuck to the valve member, resulting in an easy maintenance thereof.

As can be understood from the above discussion, according to the present invention, since no turbulent flow occurs during pouring or dipping of the molten metal, neither scattering of the molten metal nor mixture of air into the molten metal takes place, and accordingly, a high quality molten metal can be obtained.

We claim:

1. A dipping and pouring apparatus comprising a molten metal holder having an interior region for receiving a body of molten metal, a duct provided at and extending from, the bottom of the molten metal holder, said duct being formed as an open ended, hollow cylindrical member whose bottom end opens into the air and whose top end opens to the interior region of said molten metal holder, and a valve member including a cylindrically formed valve body portion received in the duct and an elongated stem portion attached to said valve body and extending into the interior region of said molten metal holder, said valve body being movable in the axial direction between an open position and a closed position and being provided with a main axial passage of a diameter less than the diameter of said duct opening into the air and its other end communicating with the interior region of said molten metal holder and at least one branch passage having one end connected to the main axial passage, whereby said valve member is movable for selectively connecting the interior region of the molten metal holder to the main axial passage.

2. A dipping and pouring apparatus according to claim 1, further comprising a protecting shroud provided in the molten metal holder, said protecting shroud extending from the bottom of said molten metal holder to substantially the top thereof and enclosing said valve member.

3. A dipping and pouring apparatus according to claim 1, wherein said molten metal holder is transportable.

4. A dipping and pouring apparatus according to claim 1, wherein said molten metal holder is constituted by a stationary molten metal holding furnace.

5. A dipping and pouring apparatus according to claim 2, wherein said protecting shroud comprises a cylinder in which the valve member is movably inserted.

6. A dipping and pouring apparatus according to claim 5, wherein said protecting shroud contains openings for communication with said branch passages and said valve body is movable in an axial direction between an open position in which said branch passages communicate with said openings and a closed position in which said branch passage do no communicate with said openings.

7. A dipping and pouring apparatus according to claim 1, further comprising a seal means between said duct and the bottom of said molten metal holder for preventing the molten metal contained therein from leaking therefrom.

8. A dipping and pouring apparatus according to claim 1, including means for exchangeably connecting said valve body to said valve stem portions.

* * * * *